United States Patent [19]

Harima et al.

[11] Patent Number: 4,746,905

[45] Date of Patent: May 24, 1988

[54] SOUND PRODUCING DEVICE

[75] Inventors: Masanori Harima, Haibara; Kohsho Ohshima, Yamatokoriyama, both of Japan

[73] Assignee: Matsushita Electric Industrial Co., Ltd., Kadoma, Japan

[21] Appl. No.: 887,388

[22] PCT Filed: Nov. 24, 1982

[86] PCT No.: PCT/JP82/00449

§ 371 Date: Jul. 22, 1983

§ 102(e) Date: Jul. 22, 1983

[87] PCT Pub. No.: WO83/02030

PCT Pub. Date: Jun. 9, 1983

Related U.S. Application Data

[63] Continuation of Ser. No. 522,364, Jul. 22, 1983, abandoned.

[30] Foreign Application Priority Data

Nov. 25, 1981 [JP] Japan ..... 56-189731

[51] Int. Cl.[4] ..... G08B 3/00

[52] U.S. Cl. ..... 340/384 E; 340/384 R; 310/348

[58] Field of Search ..... 340/384 E, 384 R; 310/322, 323, 324, 345, 348

[56] References Cited

U.S. PATENT DOCUMENTS

| | | | |
|---|---|---|---|
| 3,198,489 | 8/1965 | Finch | 310/322 |
| 4,122,365 | 10/1978 | Stephens | 310/324 |
| 4,175,262 | 11/1979 | Harakawa et al. | 340/384 E |
| 4,374,377 | 2/1983 | Saito et al. | 340/384 E |
| 4,451,754 | 5/1984 | Stolz et al. | 310/348 |
| 4,496,871 | 1/1985 | Sumita et al. | 310/324 |

FOREIGN PATENT DOCUMENTS

| | | | |
|---|---|---|---|
| 0132186 | 10/1979 | Japan | 310/346 |
| 0160580 | 11/1979 | Japan . | |

*Primary Examiner*—John W. Caldwell, Sr.
*Assistant Examiner*—Tyrone Queen
*Attorney, Agent, or Firm*—Wenderoth, Lind & Ponack

[57] ABSTRACT

Conventionally, such a sound producing device as a ceramic buzzer is constructed separately from its electric circuit that vibrates the buzzer. In contrast, in the present invention, one wall surface of a resonance frame (16) having a sound producer (3) fixed thereto is defined by a lid in the form of a printed circuit board (22) formed with a sound release hole (12), and electric parts constituting an electric oscillation circuit are arranged on the lid, thereby providing a sound producing device which is very compact and whose sound producing characteristics is stabilized.

4 Claims, 3 Drawing Sheets

SOUND PRODUCING DEVICE

This application is a continuation of now abandoned application Ser. No. 522,364, filed July 22, 1983.

TECHNICAL FIELD

The present invention relates to a sound producing device equipped with a so-called ceramic sound producer for producing acoustic signals to report to the user the working condition of an electric apparatus, such as a microwave oven, which incorporates said device.

TECHNICAL BACKGROUND

Recently, electric apparatuses, such as microwave ovens, having an electronic control device in the form of a combination of a microcomputer and a keyboard have been put to practical use. Concurrently therewith, buzzers and other sound producing devices are being used in large quantities.

The sound producing property of such sound producing device depends largely on the arrangement of the sound producer and resonance box and also varies greatly with the way they are assembled. Thus, in order to stabilize the sound producing property, it has been necessary to arrange the sound producer and resonance box so that the sound producing property does not vary with the way they are assembled.

For example, a conventional buzzer 1 of this type used in a microwave oven, as shown in FIGS. 1–5, comprises a resonance case 2, a sound producer 3, and input lead wires 4 and 5 connected to the electrode plates of the sound producer 3 to obtain electric signals from the outside. As for the sound producing principle of this type of sound producing devices, there are two types, the separate excitation type wherein both ON- and OFF-signals are applied to the lead wires 4 and 5, and the self-excitation type wherein the piezoelectric property of a ceramic sound producer is utilized to apply only ON-signals thereto to cause vibration. The conventional example is of the separate excitation type.

The sound producer 3 is built up of a metal electrode plate 6 and a ceramic electrode plate 7 which are bound together by an adhesive agent 8. The peripheral edge of the metal electrode plate 6 of the sound producer 3 is fixed to the peripheral edge of an opening 9 at one end of the resonance case 2 by an adhesive agent 10, as shown in FIG. 5. In this condition, if an oscillation waveform is applied to the input lead wires 4 and 5, the ceramic electrode plate 7 of the sound producer 3 is deflected according to the frequency of the ocillation wave and produces a sound. The sound pressure is determined when the resonance frequency dependent on the volume of the resonance case 2 and on the inner diameter of a sound release hole 12 formed in the other end surface 11 of the resonance case 2 coincides with the frequency of the oscillation waveform applied from the outside. In addition, the resonance frequency f of the resonance case 2 is $$f = \frac{C}{2\pi}\sqrt{\frac{4A^2}{D^2H(L+KA)}} \quad (1)$$

where f is the resonance frequency; C is the velocity of sound; A is the radius of the sound release hole 12; D is the support diameter of the sound producer 3; H is the depth of the resonance case 2; K is a constant; and L is the depth of the sound release hole 12.

This conventional sound producing device has the following drawbacks which have been serious problems.

(1) If the amount of the adhesive agent 10 fixing the sound producer 3 and the resonance case 2 to each other is too small, there is formed a clearance between the resonance case 2 and the sound producer 3, producing a dissonance which disturbs the sound. Further, if the amount of the adhesive agent 10 is too large, as shown in FIG. 5, the adhesive agent 10 intrudes into the resonance case 2, changing the support diameter D of the sound producer 3, so that, as is clear from equation 1, the resonance frequency f changes and the sound pressure decreases. Thus, what is required is uniform application of a proper amount, but this is difficult to attain and hence the performance has been unstable.

(2) As shown in FIG. 6, a sound producing device 13 comprises a control-purpose printed circuit board 14, the conventional buzzer 1 electrically connected on said board, and oscillation circuit parts 15 for vibrating said buzzer 1 disposed around the latter. However, a large installation space is required, increasing the size of the control-purpose printed circuit board 14.

DISCLOSURE OF THE INVENTION

The present invention eliminates the drawbacks of the sound producing device described above, and provides a sound producing device having stabilized performance and high qualitative reliability, wherein in forming a resonance box of synthetic resin material, a ceramic sound producer is embedded in the resonance box to be integral with the latter.

In the sound producing device of the invention, one wall surface constituting the resonance box is provided with an electronic circuit associated with the sound producing device, so that there is a practical advantage that the space for the electronic circuit of the sound producing device is reduced to a great extent.

BEST MODE FOR CARRYING OUT THE INVENTION

Figure 1:
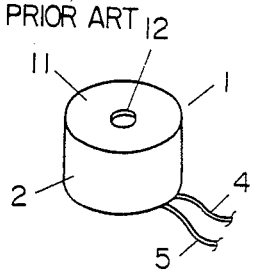
FIG. 1 PRIOR ART
FIG. 1 is an external perspective view of a conventional sound producing device.
Figure 2:
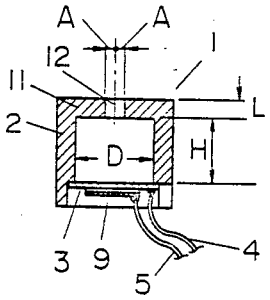
FIG. 2 PRIOR ART
FIG. 2 is a side view, in section, of said device.
Figure 3:
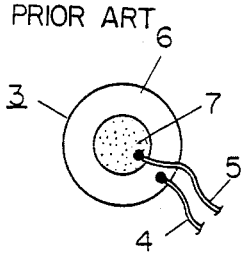
FIG. 3 PRIOR ART
FIG. 3 is a plan view of the sound producer of said device.
Figure 4:
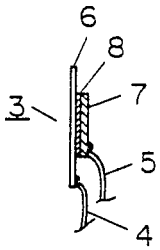
FIG. 4 PRIOR ART
FIG. 4 is a side view of the same.
Figure 5:
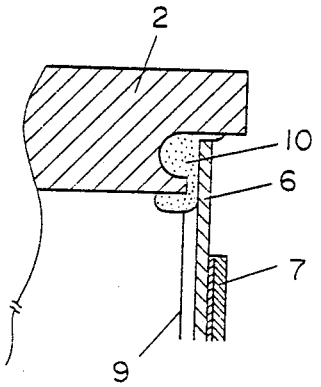
FIG. 5 PRIOR ART
FIG. 5 is an enlarged sectional view of the principal portion of the same.
Figure 6:
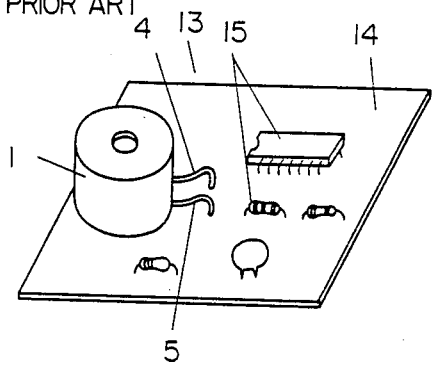
FIG. 6 PRIOR ART
FIG. 6 is an external perspective view of a printed circuit board having said device attached thereto.
Figure 7:
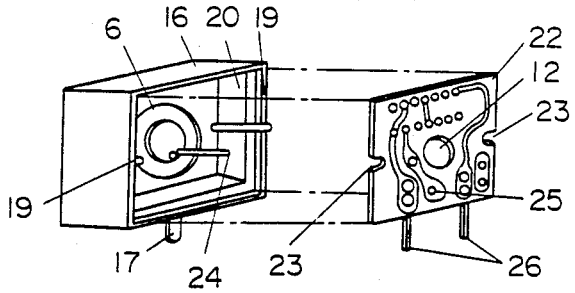
FIG. 7 is an exploded perspective view of a sound producing device according to an embodiment of the present invention.
Figure 8:
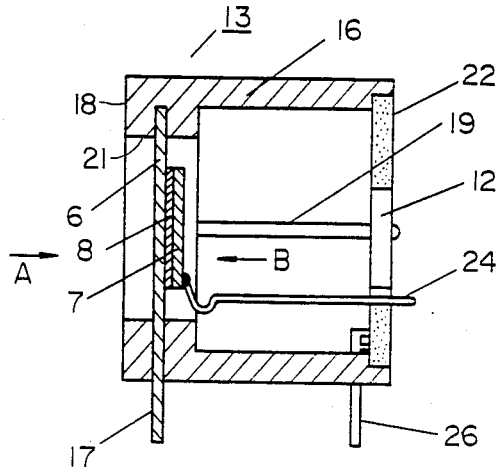
FIG. 8 is a side view, in section, of said device.
Figure 9:
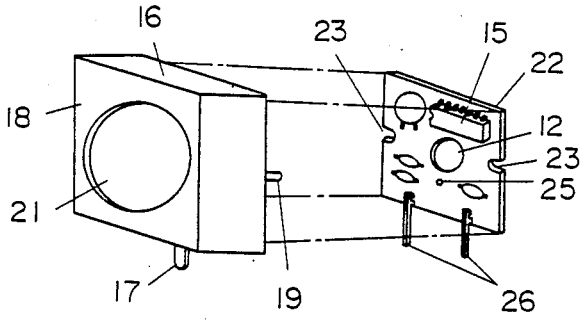
FIG. 9 is an exploded perspective view looking at the front of said device.
Figure 10:
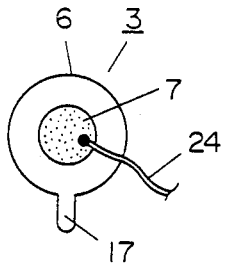
FIG. 10 is a plan view of the sound producer of said device.
Figure 11:
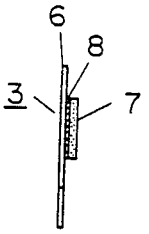
FIG. 11 is a side view of the same.
Figure 12:
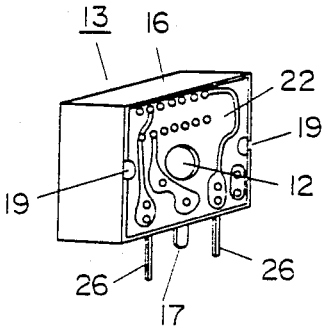
FIG. 12 is an external perspective view of said device looking at the rear thereof.
Figure 13:
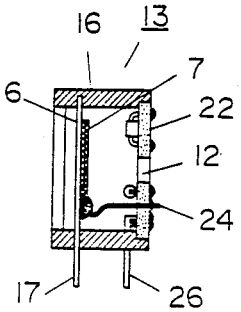
FIG. 13 is a side view, in section, of the same.

An embodiment of the invention will now be described with reference to FIGS. 7 through 13. In the figures, the metal electrode plate 6, ceramic electrode 7 and adhesive agent 8 constituting the sound producer 3 are the same in arrangement as the prior art shown in FIG. 3. A resonance frame 16 is a frame made of synthetic resin, and the numeral 17 denotes an input terminal integral with the metal electrode plate 6. The resonance frame 16 has a sound producer holding wall 18 wherein mating dies are put together in opposite directions A and B to embed the periphery of the metal electrode plate 6 of the sound producer 3 and fix it in position. Substantially the middle of this sound producer holding wall 18 is provided with a substantially circular opening 21 to allow vibration of the sound producer 3. In an opening 20 opposed to the sound producer holding wall 18 of the resonance frame 16 having the sound producer 3, a printed circuit board 22 of insulating material with the same shape as the opening 20 in the resonance frame 16 is positioned to cover the opening 20. Opposed inner lateral surfaces of the resonance frame 16 are provided with projecting locking bars 19, while the printed circuit board 22 is provided with notches 23 adapted to receive said projecting locking bars 19 so as to facilitate assembly operation. The printed circuit board 22 is fitted in the resonance frame 16 and the front ends of the projecting locking bars 19 are fused, thereby building the resonance box. Further, substantially the middle of the printed circuit board 22 is provided with a circular sound release hole 12, whereby the sound produced by vibration of the sound producer 3 is effectively released from the resonance box. The printed circuit board 22 forming part of the resonance box has mounted thereon oscillation circuit parts 15 necessary for the oscillation circuit to vibrate the sound producer 3; predetermined oscillation is effected by applying a predetermined electric input to input terminal 26 fixed to the printed circuit board 22. An electrode lead wire 24 soldered to the ceramic electrode plate 7 of the sound producer 3 extends through a lead hole 25 for a lead wire in the printed circuit board 22 and is soldered to a solder lead on the printed circuit board 22 and thereby connected to the oscillation circuit. Further, the electrode lead wire 24, when connected, is somewhat slackened so as not to interfere with vibration of the sound producer 3. The lead wire for supplying power to the metal electrode plate 6 is in the form of an integral input terminal 17 which is integral with the metal electrode plate 6, as shown in FIG. 10. Since the sound producer 3 is fixed to the resonance frame 16 in such a manner that said integral input terminal 17 projects in the same direction as input terminals 26 fixed to the printed circuit board 22, it has the function of supplying power through the integral input terminal 17 and the input terminals 26 as well as the function of attachment to other printed circuit boards. In addition, the integral input terminal 17 may be provided on the ceramic electrode plate 7.

The operation of the aforesaid arrangement is substantially the same as in the conventional arrangement. Thus, when an oscillation waveform is applied between the integral input terminal 17 of the metal electrode plate 6 and the electrode lead wire 24, the ceramic electrode plate 7 is deflected, and this deflection is amplified by the metal electrode plate 6, producing a sound through the sound release hole 12.

Since the present embodiment is so arranged that the oscillation circuit parts 15 mounted on the printed circuit board 22 are stored in the resonance box, it has the effect of making the sound producing device itself compact.

According to the present embodiment, a number of effects enumerated below can be obtained.

(1) Integral formation of the sound producer 3 and resonance box 16 ensures that support points for the sound producer 3 are kept unchanged, and nonuse of an adhesive agent makes it no longer necessary to manage to provide for uniform application of adhesive agents, eliminating the possibility of the sound being disturbed by non-uniform application of adhesive agents and of the sound pressure dropping owing to a shift in resonance frequency; thus, it is possible to stabilize the performance.

(2) Integral attachment of the printed circuit board 22 constituting the oscillation circuit to the resonance box 16 reduces the size of the sound producing device and saves space.

(3) Integral formation of the metal electrode plate 6 of the sound producer 3 with the input electrode projecting therefrom eliminates the need to separately connect an input lead wire, thus facilitating assembly and increasing strength.

(4) The lead wire connected to the ceramic electrode plate 7 of the sound producer 3 extends through the printed circuit board 22 constituting the oscillation circuit and is soldered on the copper foil surface. As a result, the number of lead wires for take-out wiring in the conventional arrangement is reduced by one, thus facilitating assembly.

(5) If the resonance box is provided with a sound release hole 12, this would complicate the mold for the resonance box. In contrast, formation of the sound release hole 12 in the printed circuit board constituting the oscillation circuit simplifies the molding of resin into the resonance box, reduces the cost of the mold, facilitates formation of the sound release hole 12, and improves the performance of the sound producing device itself and reduces its cost.

INDUSTRIAL APPLICABILITY

As has been described so far, according to the present invention it is possible to provide a compact sound producing device which has improved sound producing performance and stabilized quality. Thus, it is possible to provide a sound producing device adapted for control by electronic circuits, which finds a broad range of uses in the field of electric apparatuses including microwave ovens.

We claim:

1. A sound producing device comprising:

a sound producer for producing a sound in response to a predetermined electric signal, said sound producer having a peripheral edge;

a resonance box made of resin, said peripheral edge of said sound producer being held in said resonance box by being molded in the resin of said resonance box for mounting said sound producer in one end of said resonance box, and closing one said end of said resonance box, the other end of said resonance box opposed to said sound producer being open; and a lid mounted in said open end of said resonance box and closing said resonance box, said lid being a printed circuit board having an unobstructed sound release hole therethrough having a size for permitting the sound to be effectively released from said resonance box, said sound release hole being open to the outside of said resonance box, said printed board having an oscillation circuit thereon electrically connected to said sound producer.

2. A sound producing device as claimed in claim 1 wherein said sound producer includes a metal electrode plate and a ceramic electrode plate adhesively bonded together, and the metal electrode of the sound producer having the peripheral edge embedded in the resin of the resonance box for fixing the sound producer to the resonance box.

3. A sound producing device as claimed in claim 2 in which said resonance box has a further opening at the opposite end from the first mentioned opening, said sound producer being mounted on said resonance box for filling said further opening and forming an end wall of said resonance box.

4. A sound producing device as claimed in claim 2 wherein said metal electrode plate has an input terminal integral therewith projecting outside the resonance box.

* * * * *